United States Patent [19]

Goddard et al.

[11] 4,321,108

[45] Mar. 23, 1982

[54] FOURDRINIER TABLE

[75] Inventors: Denis A. Goddard, Beloit, Wis.; Louis E. Dennis, Jr., Hillsboro, Oreg.

[73] Assignee: Beloit Corporation, Beloit, Wis.

[21] Appl. No.: 184,987

[22] Filed: Sep. 8, 1980

[51] Int. Cl.[3] ..... D21F 1/52; D21F 1/54

[52] U.S. Cl. ..... 162/272; 162/352

[58] Field of Search ..... 162/272, 351, 352, 354, 162/374

[56] References Cited

U.S. PATENT DOCUMENTS

| | | | |
|---|---|---|---|
| 3,052,296 | 9/1962 | Justus | 162/354 |
| 3,332,838 | 7/1967 | Lee | 162/352 |
| 3,585,105 | 6/1971 | Stuebe | 162/211 |
| 3,645,844 | 2/1972 | Grenier | 162/352 |
| 3,762,991 | 10/1973 | Justus | 162/352 |
| 4,088,531 | 5/1978 | Lamminen | 162/352 |
| 4,140,573 | 2/1979 | Johnson | 162/352 |

*Primary Examiner*—Richard V. Fisher

*Attorney, Agent, or Firm*—Hill, Van Santen, Steadman, Chiara & Simpson

[57] ABSTRACT

A fourdrinier table assembly of a length to underlie a substantial portion of the forming length of a traveling fourdrinier wire in a paper making machine, and having a plurality of supporting rails carried by supporting structure in side-to-side spaced relation to one another and arranged to span the forming length portion in the machine direction below the fourdrinier wire, a series of elongate dewatering foils being carried by and extending in cross machine direction across the supporting rails in spaced relation to one another along the length of the rails and adapted to act in dewatering relation with respect to the underside of the traveling fourdrinier wire. The foils are retained adjustably and replaceably on the rails. The supporting structure for the rails comprises beams extending in cross machine direction and spaced from one another in the machine direction.

35 Claims, 12 Drawing Figures

FOURDRINIER TABLE

This invention relates to the art of paper making and is more particularly concerned with a new and improved fourdrinier table.

Paper making machines of the fourdrinier type operating at high speed may be equipped downstream from the head box with a so-called table over which the forming run of an endless loop fourdrinier wire travels as the fibrous paper stock slurry fed to the fourdrinier belt or wire is progressively dewatered to become a felted mat resulting in the desired paper sheet web. An example of a fourdrinier table is found in U.S. Pat. No. 3,052,296 which discloses not only a flat table consisting of a continuous series of flat perforated top suction boxes, but also such suction boxes provided with a series of successively active dewatering foils over which the fourdrinier wire travels. Mounting of the foils on framework sections is disclosed in U.S. Pat. No. 3,585,105. A representative example of means for individually supporting the foils on beams extending in the cross machine direction is found in U.S. Pat. No. 3,762,991.

Such dewatering foils must be of considerable length, which may be as great as thirty feet in high production machines. In the prior art arrangements numerous problems have been encountered, among which may be mentioned relatively high cost for the original equipment, excessive time required to install the equipment, inability to remove foils while the machine is in operation, inability to add foils as desired, inability to adjust the spacing of the foils longitudinally of the machine direction, or requiring excessive machine down time to accomplish such adjustment, limited foil capacity on the suction boxes, requirement for excessive releveling of the table if the equipment is moved, complications in effecting cross machine deflection of the foils, lack of versatility as to provision of vacuum areas in the table or relocation of vacuum areas, etc.

It is to the alleviation of the foregoing and other problems, disadvantages, drawbacks, inefficiencies and shortcomings inherent in the prior art relating to fourdrinier tables, and in particular the mounting of dewatering foils in such tables, that the present invention addressed.

An important object of this invention is to provide a new and improved fourdrinier table embodying an economical, relatively simple, efficient, versatile structure.

Another object of this invention is to provide a new and improved fourdrinier table which greatly facilitates foil arrangement, placement and adjustment.

A further object of this invention is to provide a new and improved fourdrinier table which avoids the restrictions commonly experienced with suction boxes on which dewatering foils are mounted.

Still another object of this invention is to provide a new and improved fourdrinier table which permits table relocation or replacement without the need to relevel the table upon such an occurrence.

Yet another object of the invention is to provide a new and improved fourdrinier table structure which facilitates adjustment of the cross machine deflection with minimum paper machine down time.

A yet further object of the invention is to provide a new and improved fourdrinier table assembly which facilitates selection of or relocation of vacuum areas along the table.

This invention provides a fourdrinier table assembly of a length to underlie a substantial forming length of a travelling fourdrinier wire in a paper making machine, and comprising a supporting structure adapted to be located below the forming length, a plurality of supporting rails carried by the supporting structure and arranged to span the forming length longitudinally below the fourdrinier wire and in side-to-side spaced relation to one another. Elongate dewatering foils are carried by and extend across the supporting rails in spaced relation to one another along the length of the rails and are adapted to act in dewatering relation on the underside of the traveling fourdrinier wire. Means are provided for retaining the foils adjustably and replaceably on the rails. The fourdrinier table supporting structure desirably comprises a plurality of spaced beams arranged to extend transversely under the paper forming length, the rails being carried on top of and spanning across and between the beams.

Other objects, features and advantages of the invention will be readily apparent from the following description of certain representative embodiments thereof, taken in conjunction with the accompanying drawings although variations and modifications may be effected without departing from the spirit and scope of the novel concepts embodied in the disclosure and in which.

Figure 1:
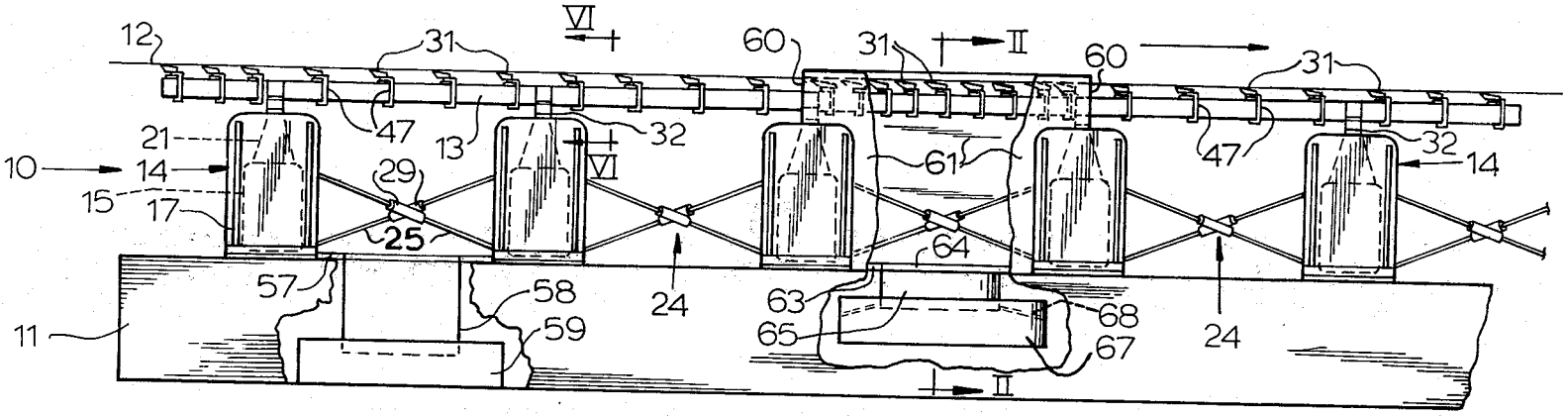
FIG. 1 is a fragmentary side elevational view of a fourdrinier table embodying the invention.

A fourdrinier table 10 (FIG. 1) embodying the present invention is adapted to be mounted on a machine frame or other supporting structure 11 and comprises an assembly of a length to underlie a substantial forming length of a traveling fourdrinier wire 12 in a paper making machine. Fourdrinier paper making machines are well known in the art, but if desired reference may be had to the aforesaid U.S. Pat. No. 3,052,296 for a fairly comprehensive disclosure of the manner of operation of such machines. In brief, paper stock is deposited on the upper or forming run of the endless loop fourdrinier wire 12 from a head box (not shown) as the wire travels downstream from the head box over a suction box or forming board where initial dewatering and felting of the paper stock occurs. Then the wire 12 travels on over and along the table 10 which underlies the remainder of the forming length of the wire for substantially completing dewatering of the felted paper web carried by the wire. As the mat of paper stock is carried by the wire along the forming run or length and progressively dewatered, the mat becomes a self-sustaining paper web so that at the downstream end of the forming length the formed paper web can be transferred to further processing equipment, such as drying rolls, calender, and the like. It will be appreciated that the fourdrinier wire 12 may be thirty or more feet in width, and operated to travel up to at least 2,000 feet per minute.

In one preferred construction, the fourdrinier table 10 comprises a plurality of supporting rails 13 arranged to span a substantial portion of the forming length longitudinally below the fourdrinier wire and in side-to-side spaced relation to one another. In a typical construction, the rails 13 may be located at about 30" spaced intervals in the cross machine direction. Each of the rails 13 may be in and of itself of a length to extend the entire table length. If for any reason such a monolithic length is not desired, the rails may, of course, be provided in shorter sections secured end-to-end or at least mounted to extend end-to-end. Whether or not directly connected to one another in end-to-end relation, the rails should function in each rail extent to span the portion of the forming length along which the table 10 is operational.

Figure 2:
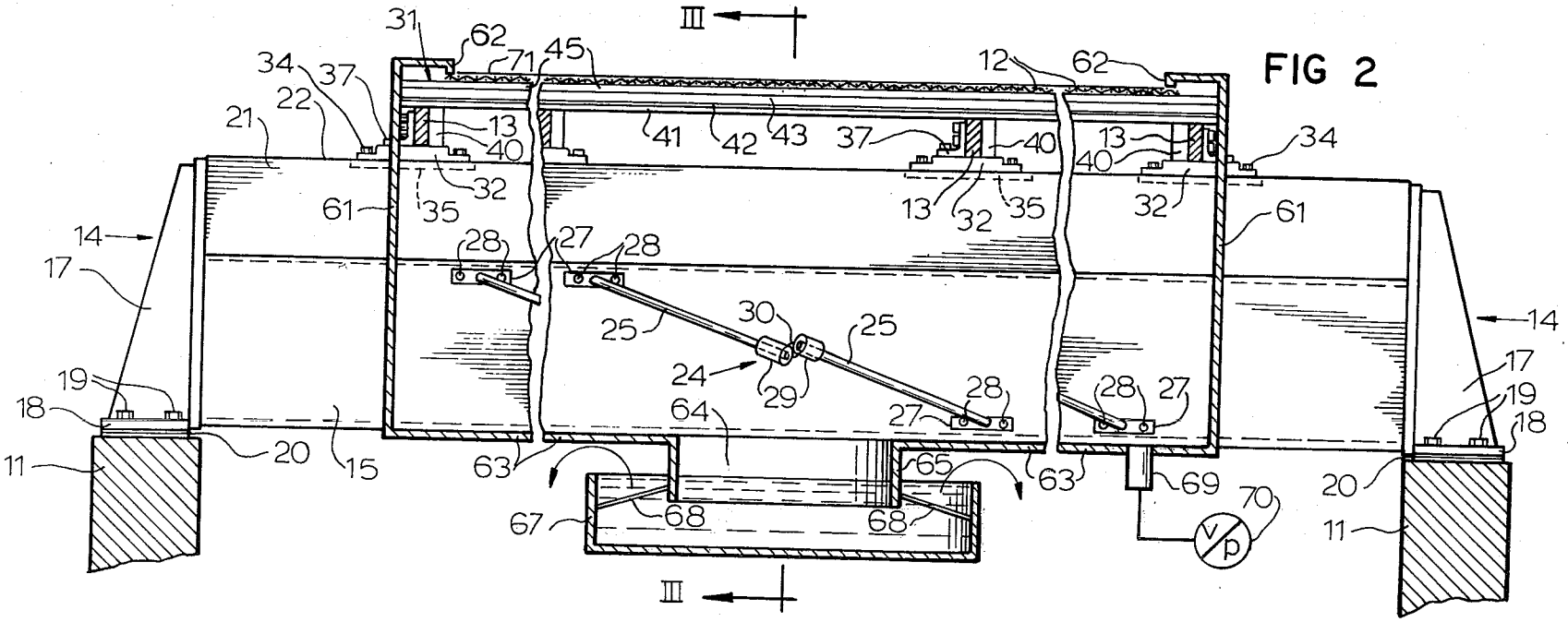
FIG. 2 is an enlarged fragmental vertical sectional detail view taken substantially along the line II—II of FIG. 1.
Figure 3:
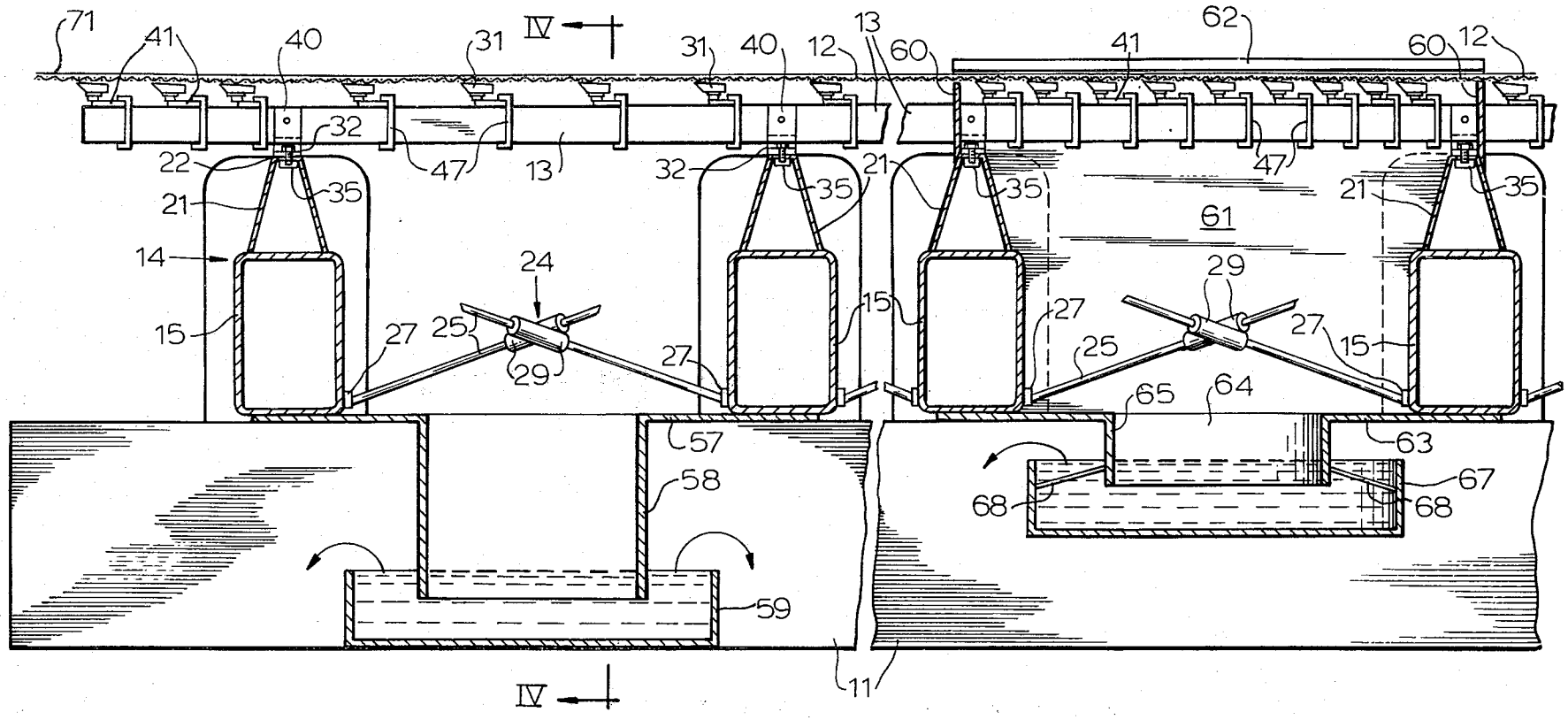
FIG. 3 is a fragmental vertical sectional detail view taken substantially along the line III—III of FIG. 2.

In a preferred arrangement, the rails 13 are carried on top of a plurality of spaced beams 14 which extend transversely under the rails 13 and thus under the forming length of the traveling fourdrinier wire 12. As best seen in FIGS. 2 and 3, the beams 14 are desirably in the form of rugged hollow box beam sections of a length to span the cross machine distance. At each opposite end, each beam section 15 is secured as by means of welding to an upstanding mounting bracket 17 having a base plate 18 secured as by means of bolts 19 to the top of the support means 11. Leveling shims 20 may be installed between the mounting bracket bases 18 and the support means 11.

Figure 5:
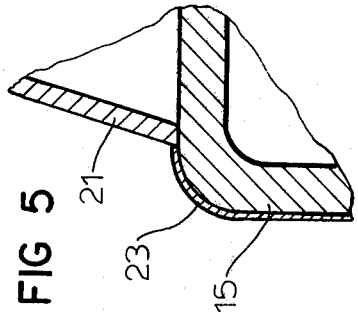
FIG. 5 is an enlarged fragmentary sectional detail view taken substantially along the line V—V in FIG. 4.

Each of the beam sections 15 carries thereon a coextensive mounting shoulder section 21 which may be formed from lighter gauge material. At their opposite ends the shoulder sections 21 are desirably secured as by means of welding to upper portions of the brackets 17. In a preferred structure, the shoulder sections 21 are of inverted generally V-shaped cross-section with lower edges of the V-legs mounted on the upper sides of the beam sections 15 and with an upper flat connecting web platform area 22 underlying the rails 13. The mounting shoulder sections 21 may be formed up from stainless steel sheet of suitable gauge, while the beam sections 15 may be formed from a lesser grade of steel and provided with a protective cladding 23 (FIG. 5) which may be stainless steel sheet, plastic material such as fiber glass, high grade paint or the like.

For stabilizing the beams 14, a suitable plurality of sets of cross braces 24 secured to and between the confronting sides of the adjacent beams 14 connect the entire beam assembly into a stabilized functional unit. By way of example, in the disclosed embodiment, three of the stabilizing cross braces or ties 24 are secured to and between the confronting sides of each of the beams 14 and its neighbors at either side and at suitable spaced intervals along the lengths of the beams. Thus, the arrangement of the stabilizers 24 may be a respective one adjacent to each end and one at about the cross machine center of the beam and in each location aligned in the machine direction with the other similarly located stabilizers. In the preferred construction, each of the stabilizers 24 comprises a pair of crossingly related stainless steel rods 25, each of which has a fixedly at each opposite end an attachment plate 27 adapted to be secured as by means of a pair of screws 28 to the side of the beam section 15 with which associated. The arrangement is such that in respect to each of the stabilizers 24, the attachment plates 27 at opposite ends of each of the stabilizer rods 25 are respectively attached to the upper and lower margins of the respectively opposite beam section sides. By having the rods 25 disposed in crossing relation and extending not only diagonally between the beam sides but also diagonally in the direction of the length of the beams, thorough lateral and lengthwise stabilization of the beams relative to one another is attained in the assembly. Not only to enhance stabilization effect of the stabilizers 24, but also to secure the rods 25 in each of the stabilizers 24 into a unit which will facilitate mill assembly of the stabilizers with the beams in the course of erection of the table 10, each of the rods 25 is provided substantially centrally therealong with a welding enlargement 29 which may conveniently be provided in the form of a length of tubing in the form of a sleeve which may be fixedly welded in place on the respective rod. At the crossing of the rods 25, the sleeves 29 crossingly contact one another and are fixedly secured together as by means of welding 30 (FIG. 2). Thereby, the stabilizers 24 are adapted to be handled as substantially rigid units for packing, shipment and installation. Not only the rods 25, but the attachment plates 27 and the weld member sleeves 29 may be made from stainless steel.

Figure 6:
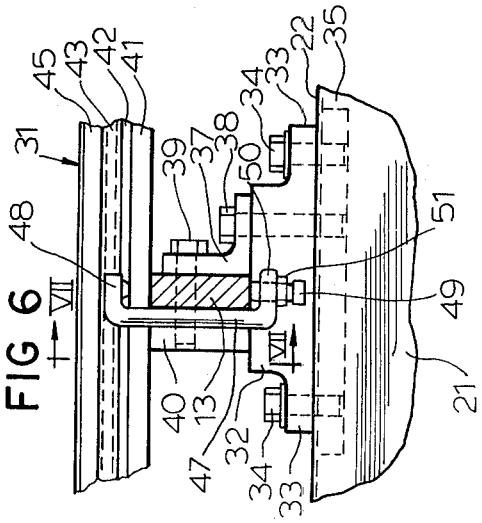
FIG. 6 is an enlarged fragmentary sectional elevational detail view taken substantially along the line VI—VI in FIG. 1.

Mounting of the rails 13 on the shoulder platforms 22 is desirably effected in a manner to permit ready cross machine deflection if desired with respect to dewatering foils 31 extending in cross machine direction and supported by the rails. Accordingly, at each of the beams 14, each of the rails 13 is mounted to the shoulder platform 22 by means of a rigid plastic pad 32 (FIGS. 2 and 6). These plastic pads 32 are adapted to be readily machined to accommodate any preferred spacing between the underside of the associated rail 13 and shoulder platform 22. Each pad has means for attaching it to the shoulder platform 22, desirably comprising oppositely extending attachment flanges 33 adapted to be secured as by means of one or more bolts 34 threaded into a respective suitably tapped clamping plate 35 underlying the shoulder platform 22 (FIGS. 2, 3 and 6). Attachment of the rail 13 onto the top of the mounting pad 32 is desirably effected by means of an L-shaped angle bracket 37, a horizontal leg of which is secured by at least one bolt 38 onto the top of the pad 32 and extending downwardly through the pad and threadedly secured to the clamping plate 35. An upright leg of the angle bracket 37 is secured by one or more bolts 39 to the rail 13. For stability, the shank of the bolt 39 desirably extends through the rail 13 and is threadedly engaged with a stabilizing block or plate 40 on the opposite side of the rail from the bracket 37. The plate 40 desirably has about the same cross-sectional mass dimension as the rail 13 and has upper and lower edges in a plane with the upper and lower edges of the rail 13, so that the lower edge of the plate 40 engages the top of the pad 32.

Figure 7:
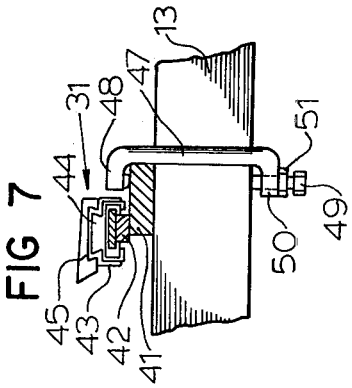
FIG. 7 is a fragmentary sectional elevational detail view taken substantially along the line VII—VII of FIG. 6.

Each of the foils 31 comprises a base cross bar 41 (FIGS. 2, 6 and 7) which is of a length to extend over and be supported on all of the rails 13 in the cross machine direction. Each of the foil base bars 41 is of substantial width and carries on and along its upstream margin (having regard to the direction of fourdrinier wire movement) a substantially T-shaped connecting rib 42 to which is slidably mounted a complementally grooved gib member 43 having a dovedtail cross-section crown 44 onto which is slidably engaged a foil blade 45 having any desired blade angle. The blade 45 may be one continuous length formed from ceramic or polyethylene or may be in a plurality of sections extending in end-to-end relation on the gib bar 44.

Each of the foil base cross bars 41 is adapted to be fixedly attached to the rails 13 in a readily adjustable and replaceable manner. To this end, substantial area along the downstream margin of each of the bars 41 provides a securement area adapted to be engaged by means for effecting selective fixed attachment to the underlying rails 13. In one desirable form the attachment means comprise in each instance a modified C-clamp 47 having an upper offset arm 48 to engage the attachment area of the bar 41 with a clamping grip, clamping force being applied through an upwardly extending thrust screw 49 threaded through a lower arm 50 of the member 47 and which arm underlies the associated rail 13. After the securing clamp 47 has been throughly tightened by means of the thrust screw 49, a lock nut 51 locks the screw against inadvertent loosening. Through this arrangement, the foils 31 are adapted to be secured adjustably at a desired location along the rails 13, attaining great versatility as to not only location but as to numbers, spacings between foils and to accommodate other apparatus that may be associated with the table 10.

Figure 8:
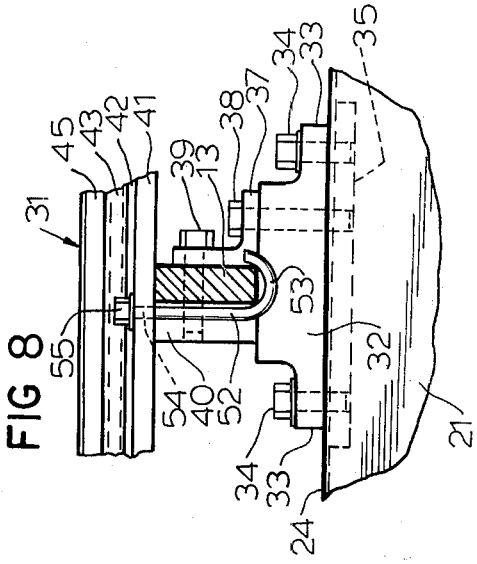
FIG. 8 is a fragmentary sectional detail view similar to FIG. 6, but showing a modification.

In a modified arrangement, as shown in FIG. 8, for adjustably and replaceably securing the bars 41 to the rails 13, a J-bolt 52 may be employed. For this purpose, hook portion 53 of the J-bolt is adapted to be engaged on the underside of the rail 13, while the long arm of the bolt extends up through a suitable aperture 54 in the bar 41 and is secured as by means of a nut 55. This arrangement is not as versatile as the C-clamp 47 because with the C-clamp there is no limitation upon lengthwise adjustments of the bars 41 relative to the rails 13. On the other hand, the J-bolt 52 does permit adjustments of the bars 41 along the lengths of the rails 13, and replacement of the bars 41 may be readily effected by removal or dropping of the J-bolts 52.

In a typical installation, the beams 14 may be located at about three foot intervals on center. The overall height of the table from the bottom of the beams 14 to the tops of the foil blades may be on the order of two feet. As great a length as desired can be attained by simple multiplication in the series of beams and lengths of the rails 13. The width of the table may be as great as desired. The rails 13 may be placed in spaced relation about 30" on center, and the foil base bars 41 may be of any desired length to accommodate the particular width of the fourdrinier wire. All exposed metal parts may be stainless steel to withstand corrosion or at least treated or coated to resist corrosion, considering the use to which the apparatus is put in dewatering the paper web.

Figure 4:
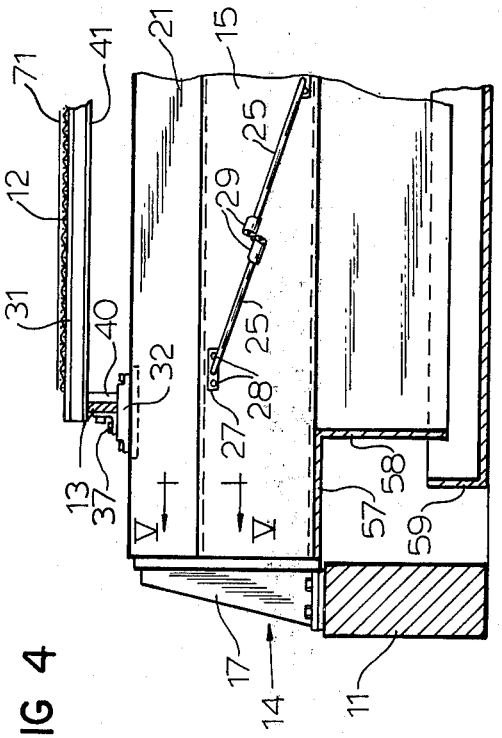
FIG. 4 is a fragmentary vertical sectional detail view taken substantially along the line IV—IV in FIG. 3.

If desired, at any location along the length of the table, means may be provided for controlling water that drains down through the table, and particularly the drainage down between the beams 14. One such drainage means as shown in FIGS. 1, 3 and 4, may comprise a drainage floor 57 between any selected one or more of a pair of the beams 14 and having a tubular drop leg 58 which discharges into a splash preventing sump 59 from which the waste water spills to drainage.

If vacuum drainage is desired at any location along the table, the space between adjacent ones of the beams 14 lends itself to a generally suction box arrangement as depicted in FIGS. 1, 2 and 3. For this purpose, vertical seals 60 are provided between the underside of the wire 12 and the tops of the shoulders 21. Since the beam sections 15 and the shoulders 21 are solid and continuous in the cross machine direction, the beams serve with the seals 60 as closures for the upstream and downstream ends of the suction box space. At each opposite side of the table 10, the suction box space is closed by respective walls 61 which desirably have deckle seals 62 on their upper ends cooperating with the sides of the wire 12. A bottom wall 63 closes the bottom of the suction box space and has a drainage port 64 from which a drop leg 65 projects downwardly into a water seal pan 67 which may be suspended from the drop leg 65 by means of tie rods 68. Waste water collected in the thus formed suction box discharges into the pan 67 from the lower end of the drop leg 65, which is immersed in the body of water in the pan and thus provides a vacuum seal so that vacuum drawn in the suction box through means such as a vacuum duct 69 and a vacuum pump 70 will be thoroughly effective in accelerating dewatering of a paper web 71 carried by the wire 12. Dewatering efficiency is enhanced by a fairly close spacing of the foils 31 along the top of the suction chamber, as compared to the spacing of such foils in the absence of the suction chamber, as best visualized in FIGS. 1 and 3. Effective vacuum may be controlled to be in a range of about 8–15" $H_2O$.

Referring to FIGS. 9–12, a fourdrinier table 100 is operationally substantially the same as the table 10 already described, being mounted on a machine frame or other supporting structure 101, and comprising an assembly of a length to underlie a substantial forming length of a travelling fourdrinier wire 102 in a paper making machine. A plurality of spaced beams 103 extends transversely or in a cross-machine direction, being supported by the machine frame 101 at suitably spaced intervals, having regard to the machine direction, under the forming wire 102. Supported on the beams 103 in a manner to span a substantial portion of the forming length longitudinally below the fourdrinier wire 102 is a plurality of supporting rails 104 located at spaced intervals considered in the cross machine direction. Mounted at suitably spaced intervals considered in the machine direction is a plurality of foil assemblies 105 extending in parallel relation in the cross machine direction and each having a dewatering foil 107.

Each of the beams 103 is constructed as a rugged hollowbox beam section of a length to span the cross machine distance. By way of example, each of the beams 103 is desirably a convenient functionally integrally welded structure comprising coextensive complementary opposite side plates 108, a bottom plate 109 and a top flat platform web plate 110. The elements 108, 109 and 110 are welded together to provide an elongate tube which is higher than wide, and the opposite ends of which are sealed closed by means of respective end plates 111 which are welded onto the respective opposite ends of the elements 108, 109 and 110. It may be observed that desirably the bottom plate 109 and the top plate 110 are of a thicker section than the side plates 108. The upper portion of each of the beams is desirably of an upwardly tapering cross section to thereby promote shedding of water draining from the paper web being dewatered.

For attaching each of the beams 103 to the underlying machine frame 101, at least each opposite end of the beam has welded to its underside a foot plate 112 which projects at its opposite ends beyond the opposite sides of the beam and is secured as by means of hold-down bolts 113 to the machine frame 101. Adjustment and alignment of the associated beam 103 in the paper making machine is substantially facilitated by means of adjustable jacking screws 114 threadedly engaged with the respective projecting end portions of the foot plate 112 and having their heads engaging the machine frame 101. Through this arrangement, during installation, the bolts 113 are loosely secured in place, levelling and adjustment is effected by means of the jack screws 114, and then the bolts 113 are tightened and lock nuts 115 are tightened about the upper ends of the jack screws onto the foot plate 112.

For stabilizing the beams 103, stabilizer cross brace means comprising rods 117 are secured in zig-zag diagonal relation between the facing sides of adjacent beams as by means of attachment or coupling, brackets or plates 118 secured as by means of bolts 119 to the attached beam sides.

Mounting of the rails 104 on the shoulder platforms 110 may be effected in substantially the same manner, by substantially the same means and to substantially the same effect as the rails 13 are mounted on the shoulder platforms 22 in FIGS. 1–8. To this end, means comprising a rigid plastic pad 120 subjacent end of the rails 104 at each of the beams 103 has oppositely extending attachment flanges 121 secured as by means of one or more bolts 122 threadedly engaged into the bar or plate providing the shoulder platform 110. Attachment of the rail 104 onto the top of the pad 120 is by means of an L-shaped angle bracket 123 having a horizontal leg attached by means of a bolt 124 which extends downwardly through the pad 120 and is threadedly secured into the shoulder 110. An upstanding leg of the bracket 123 is secured as by means of a bolt 125 to the bar body of the rail 104.

Each of the foil assemblies 105 includes a base cross bar 127 which is of a length to extend over and to be supported on all of the rails 104 in the cross machine direction and carries the associated foil 107 on and along its upstream margin (having regard to the direction of fourdrinier wire movement). Each of the foils 107 includes a substantially T-shaped gibslike connecting rib 128 secured to the bar 127. On the rib 128 is slidably engaged a complementally gib-grooved foil blade 129 having any desired blade angle.

Means for readily adjustably and replaceably but fixedly attaching each of the base cross bars 127 to the rails 104 comprise clamps 130. In a preferred construction, each of the base cross bars 127 is of inverted U-channel shape and provided therein with respective fixedly secured transverse webs 131 located at spaced intervals throughout the length of the bar 127 and so located as to generally align with the respective rails 104.

Figures 9, 10, 11, 12:
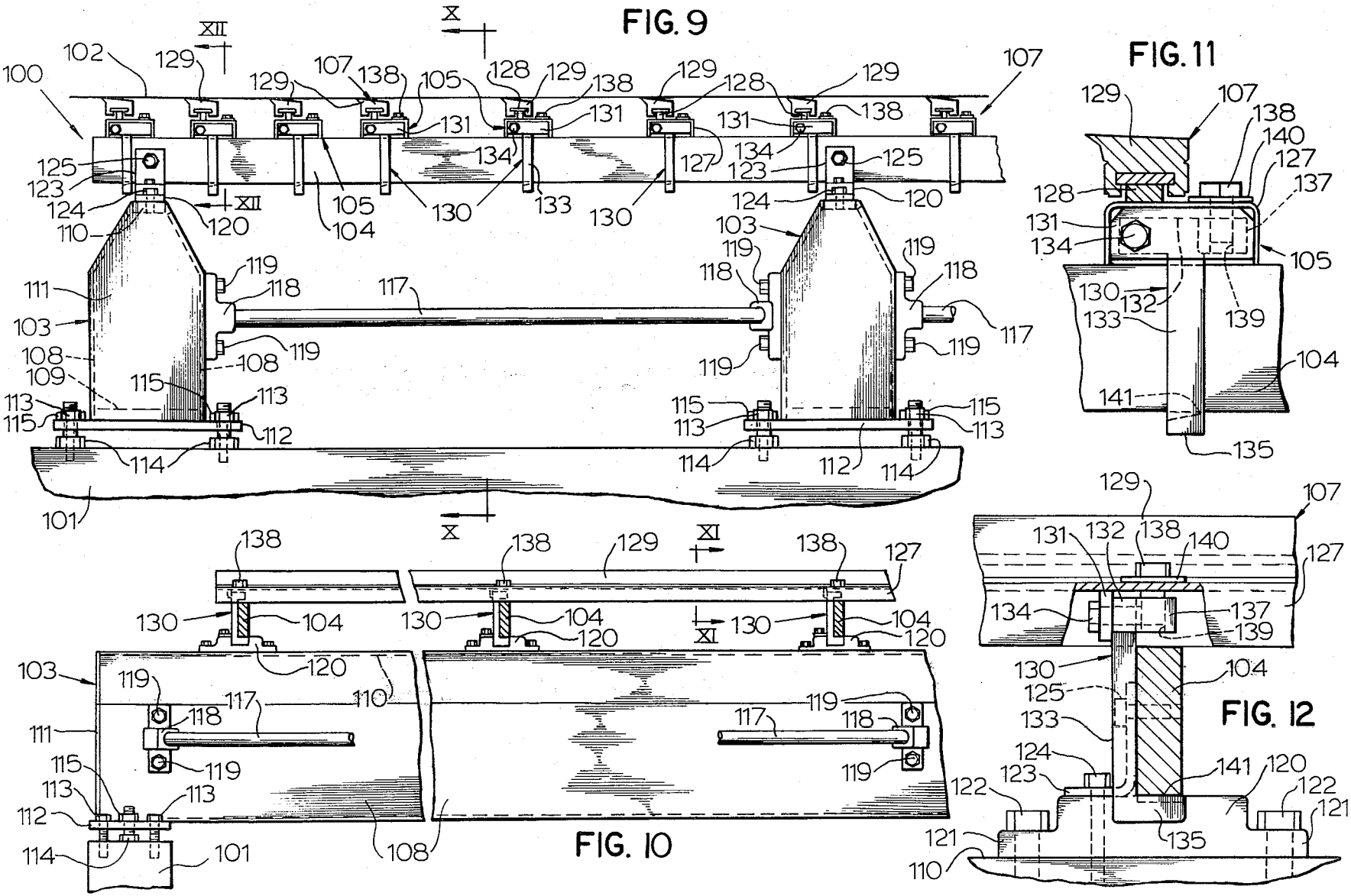
FIG. 9 is a fragmentary side elevational view of a modification of the fourdrinier table of the present invention.
FIG. 10 is a fragmental sectional elevational view taken substantially along the line X—X of FIG. 9.
FIG. 11 is an enlarged fragmentary sectional elevational view taken substantially along the line X1—X1 of FIG. 10.
FIG. 12 is an enlarged fragmentary sectional elevational detail view taken substantially along the line X11—X11 of FIG. 9.

As best seen in FIG. 11, each of the webs 131 is fixedly secured in any preferred manner such as welding at its top edge to the main body of the bar 127 and at its vertical edges to the inside of the vertical legs of the bar 127. In addition to providing rigid reinforcement for the channel shaped bars 127, the webs 131 serve as means for securing the clamps 130 in replaceable hanging assembly with the associated bar 127. For this purpose, location of each of the webs 131, as best seen in FIG. 12, is offset sufficiently from the vertical axis of the associated rail 104 to accommodate a substantially T-shaped head 132 at the upper end of an upright leg 133 of one of the clamps 130. One end portion of the T-head 132 is secured as by means of a bolt 134 to the web 131 in a manner to permit swinging of the clamp 130 about the axis of the bolt 134. At its lower end, the vertical clamp leg 133 has a horizontal clamp arm 135 which is adapted to underlie and clampingly engage the underside of the associated rail 104. To effect such clamping action, the remaining end portion of the T-head 132 has a lug 137 which is threadedly engaged by the shank of a draw-up bolt 138, the shank of which extends down through the top of the bar 127 and is threaded into a threaded bore 139 in the lug 137, while the head of the bolt 138 rests against a washer 140. To facilitate assembly of the clamping arm 135 with the underside of the rail 104 and then with the rail when the bolt 138 is drawnup tight, the upper face of the arm 135 is desirably slanted upwardly toward a gripping edge 141 along that side of such upper face which is nearest to alignment with the axis of the bolt 138.

Before assembly of the bars 127 with the rails 104, the clamps 130 are all preassembled with the respective bars 127, with the clamps 130 hanging loosely from the untightened bolts 138 and due to the overbalancing weight of lugs 137 tilted about the axis of the associated bolts 134 in each instance to provide sufficient clearance between the arms 135 and the bars 127 to permit sliding of the respective bars 127 longitudinally on the rails 104 to maneuver the clamp arms 135 into position under the associated rails 104. For this maneuver the slant top surfaces of the clamp arms 135 assure clearance at the up tilted edges of the top faces of the arms 135. After all of the clamps 130 are in position, the bolts 138 and 134 are tightened to secure the clamps 130 and thus the bars 127 to the rails 104. Should the bolts 138 become loose for any reason during operation of the machine, the clamps will, nevertheless, be held in place by the bolts 134 against dropping away from the bars 127.

The fourdrinier table of the present invention offers numerous advantages among which may be mentioned the favorably low original equipment cost. Less erection time is required in factory, and also for installation in the paper-making mill. Foil blades are adapted to be removed on the run, that is without shutting down the machine. Any number of foils may be added at very low cost. The angle of foil blades may be readily adjusted on the run. The foils may be spaced any way desired, and the spacing between foils can be effected with minimum down time. The number of foils for the table is not restricted, contrary to what may be experience with a 3-blade or 4-blade suction box arrangement. The table may not need to be relevelled if the equipment is moved, or at least levelling is greatly simplified. The foil blades may be readily changed or exchanged with no equipment change. One-piece ceramic foil blades are adapted to be used which avoids fitting problems and extra installation costs. Cross machine deflection can be easily adjusted with minimum down time by shimming the plastic pads between the rails and the supporting beams. No special rail means are needed for mounting the table. Any of the between-beam sections is adapted to become a vacuum area by adding the vacuum space or box enclosures and seals, drainage and vacuum means. If it is desired to relocate the vacuum or suction box area along the length of the table, that can be readily accomplished by moving the vacuum box enclosures and seals and associated parts without requiring any heavy equipment moving or shifting. Other advantages may also be apparent from the foregoing disclosure.

It will be understood that variations and modifications may be effected without departing from the spirit and scope of the novel concepts of this invention.

We claim as our invention:

1. A fourdrinier table assembly of a length to underlie a substantial portion of the forming length of a travelling fourdrinier wire in a paper making machine, and comprising:

a supporting structure adapted to be located below said forming length portion and including a plurality of spaced beams arranged to extend in cross machine direction supportingly under said rails and having means for securing opposite end portions of the beams to a machine frame;

a plurality of supporting rails carried by and extending across said beams in side-to-side spaced relation to one another and arranged to span said forming length portion in machine direction below said fourdrinier wire;

a series of elongate dewatering foils carried by and extending in cross machine direction across said supporting rails in spaced relation to one another along the length of said rails and adapted to act in dewatering relation with respect to the underside of the traveling fourdrinier wire;

and means for retaining said foils adjustably and replaceably on said rails.

2. An assembly according to claim 1, comprising drainage controlling means between certain of said beams.

3. An assembly according to claim 1, comprising rigid plastic pads mounting said rails on said beams.

4. An assembly according to claim 3, wherein said beams comprise hollow shoulder means, and means clamping said pads to said shoulder means.

5. An assembly according to claim 3, including attachment brackets securing said rails to said pads.

6. An assembly according to claim 1, including stabilizing bracing structure connected to and between said beams.

7. An assembly according to claim 1, wherein said beams are of hollow box beam section and said rails are supported by shoulders on top of said beams.

8. An assembly according to claim 1, including suction chamber means between certain of said beams and cooperating with said foils by effecting dewatering suction through said fourdrinier wire toward said foils.

9. An assembly according to claim 1, wherein said foils have base bars supported on said rails, and T-head clamps securing said bars replaceably to said rails.

10. An assembly according to claim 9, wherein each of said clamps has an arm engaging the underside of the associated rail, means pivotally connecting the T-head of the clamp to the associated bar, and draw-up means acting on said T-head for drawing the clamp leg up against the underside of the associated rail and thrusting the associated bar toward the top of the rail.

11. An assembly according to claim 10, wherein said bar comprises an inverted channel-shaped member, a web secured within the channel-shaped member, said pivotally connecting means connecting said T-head to said web, said T-head having a lug, and said draw-up means comprising a bolt engaging said bar and said lug.

12. A fourdrinier table assembly of a length to underlie a substantial portion of the forming length of a traveling fourdrinier wire in a paper making machine, and comprising:

a plurality of spaced beams arranged to extend transversely in cross machine direction under said forming length portion;

a plurality of spaced supporting rails carried on top of and spanning across and between said beams and adapted to extend in the machine direction under said forming length portion;

and a series of spaced elongate dewatering foils supported upon and extending in cross machine direction across said rails and adapted to act in dewatering relation with respect to the underside of the fourdrinier wire traveling along said forming length portion.

13. An assembly according to claim 12, wherein said beams are of hollow box beam construction and have top shoulder means carrying said rails.

14. An assembly according to claim 13, wherein said shoulder means comprise hollow inverted V-shaped sections having upwardly facing shoulder platforms thereon on which said supporting rails are carried.

15. An assembly according to claim 14, wherein said shoulder sections comprise non-corrosive material, and said beams below said shoulder sections have non-corrosive cladding.

16. An assembly according to claim 12, comprising stabilizers secured to and between said beams at cross machine spaced intervals.

17. An assembly according to claim 16, wherein said stabilizers comprise crossingly related diagonal brace members having their ends secured to the sides of the beams.

18. An assembly according to claim 17, including means fixedly securing contiguous portions of said crossingly related brace members together.

19. An assembly according to claim 12, wherein said beams comprise hollow beam sections and brackets secured to the ends of said sections and supporting said beams on underlying supporting means.

20. An assembly according to claim 12, including rigid plastic pads secured between said rails and said beams.

21. An assembly according to claim 12, wherein said foils comprise base bars engaged upon said rails, and means removably and adjustably securing said base bars to said rails.

22. An assembly according to claim 21, wherein said securing means comprise C-clamp members.

23. An assembly according to claim 21, wherein said securing means comprise J-bolts securing the base bars to said rails in readily separable and adjustable relation.

24. An assembly according to claim 12, including means between certain of said beams for controlling drainage.

25. An assembly according to claim 12, including means between certain of said beams defining with said certain beams a suction box enclosure, and means for effecting negative pressure in said suction box enclosure.

26. An assembly according to claim 25, including water seal drainage means from the bottom of said suction box enclosure.

27. An assembly according to claim 12, wherein said beams have upper water shedding surfaces sloping away from upwardly facing shoulders on which said rails are supported.

28. An assembly according to claim 12, wherein said beams have base means adapted for adjusting height of the beams relative to underlying support for the beams.

29. An assembly according to claim 28, wherein said base means comprise foot plates, securing bolts and jacking screws.

30. An assembly according to claim 12, wherein said foils have base bars supported on said rails, and T-head clamps securing said bars replaceably to said rails.

31. An assembly according to claim 30, wherein each of said clamps has an arm engaging the underside of the associated rail, means pivotally connecting the T-head of the clamp to the associated bar, and draw-up means acting on said T-head for drawing the clamp leg up against the underside of the associated rail and thrusting the associated bar toward the top of the rail.

32. An assembly according to claim 31, wherein said bar comprises an inverted channel-shaped member, a web secured within the channel-shaped member, said pivotally connecting means connecting said T-head to said web, said T-head having a lug, and said draw-up means comprising a bolt engaging said bar and said lug.

33. A fourdrinier table assembly of a length to underlie a substantial portion of the forming length of a travelling fourdrinier wire in a paper making machine, and comprising:

a supporting structure adapted to be located below said forming length portion;

a plurality of supporting rails carried by said supporting structure in side-to-side spaced relation to one another and arranged to span said forming length portion in machine direction below said fourdrinier wire;

a series of elongate dewatering foils carried by and extending in cross machine direction across said supporting rails in spaced relation to one another along the length of said rails and adapted to act in dewatering relation with respect to the underside of the traveling fourdrinier wire;

means for retaining said foils adjustably and replaceably on said rails;

said foils having base bars supported on said rails;

and T-head clamps securing said base bars adjustably and replaceably to said rails.

34. An assembly according to claim 33, wherein each of said clamps has an arm engaging the underside of the associated rail, means pivotally connecting the T-head of the clamp to the associated bar, and draw-up means acting on said T-head for drawing the clamp leg up against the underside of the associated rail and thrusting the associated bar toward the top of the rail.

35. An assembly according to claim 34, wherein said bar comprises an inverted channel-shaped member, a web secured within the channel-shaped member, said pivotally connecting means connecting said T-head to said web, said T-head having a lug, and said draw-up means comprising a bolt engaging said bar and said lug.

* * * * *